United States Patent [19]

Werner et al.

[11] Patent Number: 4,960,446

[45] Date of Patent: Oct. 2, 1990

[54] VACUUM CLEANER DIRT RECEPTACLE

[75] Inventors: Kurt Werner, St. Joseph Township, Berrien County; Leo G. Krieger, Bainbridge Township, Berrien County, both of Mich.; Wilbur C. Bewley, Lexington; Ennis L. Tillman, Danville, both of Ky.

[73] Assignee: Whirlpool Corporation, Benton Harbor, Mich.

[21] Appl. No.: 353,979

[22] Filed: May 19, 1989

[51] Int. Cl.[5] ..... B01D 46/24

[52] U.S. Cl. ..... 55/312; 15/352; 55/432; 55/473

[58] Field of Search ..... 15/349, 350, 351, 352; 55/312, 429, 432, 467, 473

[56] References Cited

U.S. PATENT DOCUMENTS

| | | | |
|---|---|---|---|
| 2,171,248 | 8/1939 | Van Berkel | 55/429 |
| 2,210,950 | 8/1936 | Replogle | 15/332 |
| 2,393,788 | 1/1946 | Lofgren | 55/429 |
| 2,394,798 | 2/1946 | McNeal | 55/432 |
| 3,279,157 | 10/1966 | Andersson-Sason et al. | 55/473 |
| 3,491,519 | 1/1970 | Ettridge | 55/473 |
| 3,550,182 | 12/1970 | Kivela | 55/473 |
| 3,715,775 | 2/1973 | Nickelson | 15/351 |
| 3,821,830 | 7/1974 | Sundheim | 55/467 |
| 4,225,999 | 10/1980 | Martinec et al. | 15/300 |
| 4,405,346 | 9/1983 | Tschudy et al. | 55/357 |
| 4,454,627 | 6/1984 | Simm et al. | 15/377 |
| 4,549,328 | 10/1985 | Martin et al. | 15/338 |
| 4,571,772 | 2/1986 | Dyson | 15/335 |
| 4,615,068 | 10/1986 | Martin et al. | 15/323 |
| 4,670,937 | 6/1987 | Sumerau et al. | 15/352 |
| 4,673,424 | 6/1987 | Range | 55/473 |
| 4,724,574 | 2/1988 | Bowerman et al. | 15/351 |

FOREIGN PATENT DOCUMENTS

| | | | |
|---|---|---|---|
| 2108842 | 9/1972 | Fed. Rep. of Germany | 15/352 |

*Primary Examiner*—Jay H. Woo
*Assistant Examiner*—C. Scott Bushey
*Attorney, Agent, or Firm*—Mason, Kolehmainen, Rathburn & Wyss

[57] ABSTRACT

A dirt receptacle for a vacuum cleaner includes a rigid body for collecting dirt. The body includes an aperture formed in an upper surface thereof through which dirt may flow. One or more apertures are further formed in the sidewall of the rigid body with a filter disposed in each of the apertures through which air may be exhausted from the dirt receptacle. The rigid body further includes one or more air inlet valves that allow air to enter the dirt receptacle for automatic clean out thereof.

22 Claims, 3 Drawing Sheets

10
12
14
16
18
20
22
28
32
33
34
35
36
38
40
41
42
44
46
47
48
49
50
52
54
56
58
60
68
69

62
25
26
81
23
56
77
30
24
60
66
86
70
64
84
68
82
72
78
83
79
76
80

VACUUM CLEANER DIRT RECEPTACLE

BACKGROUND OF THE INVENTION

1. Field of the Invention

The present invention relates to a vacuum cleaner and more particularly to a dirt receptacle for a vacuum cleaner.

2. Description of the Prior Art

Canister vacuum cleaners are known such as shown in U.S. Pat. Nos. 3,588,943 and 4,357,729, having a power nozzle with a beater brush driven by a motor coupled to the brush by a belt or the like. The power nozzle of such canister vacuum cleaners is typically coupled by a wand assembly to a handle having an air flow passageway therethrough that is connected to a hose assembly wherein dirt picked up by the power nozzle is directed through the wand assembly, the handle and hose assembly to a receptacle in a canister unit by a suction fan disposed therein. Upright vacuum cleaners are also known such as shown in U.S. Pat. No. 3,199,138 having a power nozzle with a beater brush driven by a motor coupled to the brush by a belt or the like wherein the motor is also coupled to an impeller or suction fan disposed in the power nozzle for directing air through a conduit to a dirt receptacle. The dirt receptacle for such upright vacuum cleaners typically is formed of a flexible cloth filter or the like that allows dirt to be retained therein while allowing air to escape therefrom. Cleaning such dirt receptacles can be cumbersome.

A rigid canister for a lightweight powered broom is shown in Richmond et al U.S. Pat. No. 4,665,582 wherein the canister is disposed between a power assembly and a mounting assembly for a nozzle. The canister includes a port in the forward end thereof adjacent the mounting assembly with a flapper door covering the port in a closed position, the flapper door opening to permit air flow into the canister. The rearward end of the canister is open and covered by a filter bag that is secured to the rearward canister end by a holding ring. Air is exhausted from the canister through the filter bag into the power assembly and out from the broom through side ports formed in the power assembly. To remove dirt from the broom, both the canister and filter bag must be manually cleaned.

SUMMARY OF THE INVENTION

In accordance with the present invention, the disadvantages of prior art dirt receptacles for vacuum cleaners as discussed above have been overcome. The vacuum cleaner dirt receptacle of the present invention includes a rigid body with air exhaust and air inlet means disposed therein to allow dirt to be collected within the rigid body and automatically cleaned out.

More particularly, the vacuum cleaner dirt receptacle of the present invention includes a rigid body for collecting dirt wherein the body includes an aperture formed in an upper surface thereof through which dirt may flow. One or more apertures are further formed in a sidewall of the body with a filter disposed in the apertures. One or more air inlets are also formed in a sidewall of the rigid body wherein the air inlets have closed and open positions such that in the open position air is allowed to enter into the dirt receptacle to allow the dirt receptacle to be automatically cleaned out.

The means for preventing air from flowing through the apertures formed in the sidewall of the dirt receptacle includes a flapper door and a means such as a spring for exerting a force on the flapper door to bias the flapper door closed. The flapper door is opened by a positive air pressure within the dirt receptacle of a sufficient magnitude to overcome the force exerted by the spring.

The air inlet means includes a valve body disposed about an air inlet aperture formed in the rigid body of the dirt receptacle. A filter is disposed in the air inlet aperture to filter air entering the dirt receptacle. The air inlet means further includes a plunger and a compression spring that is disposed between the plunger and filter. A cap having apertures therein is secured to the valve body in order to retain the plunger wherein the plunger covers the apertures in the cap when the air inlet means is in a closed position. A negative pressure within the dirt receptacle overcomes the force exerted by the compression spring to pull the plunger away from the retaining cap to allow air to flow through the apertures formed in the cap around the plunger and through the filter to the interior of the dirt receptacle to allow the dirt receptacle to be automatically cleaned out.

These and other objects, advantages and novel features of the present invention, as well as details of an illustrated embodiment thereof, will be more fully understood from the following description and the drawing.

DESCRIPTION OF THE PREFERRED EMBODIMENT

Figures 1, 2, 3:
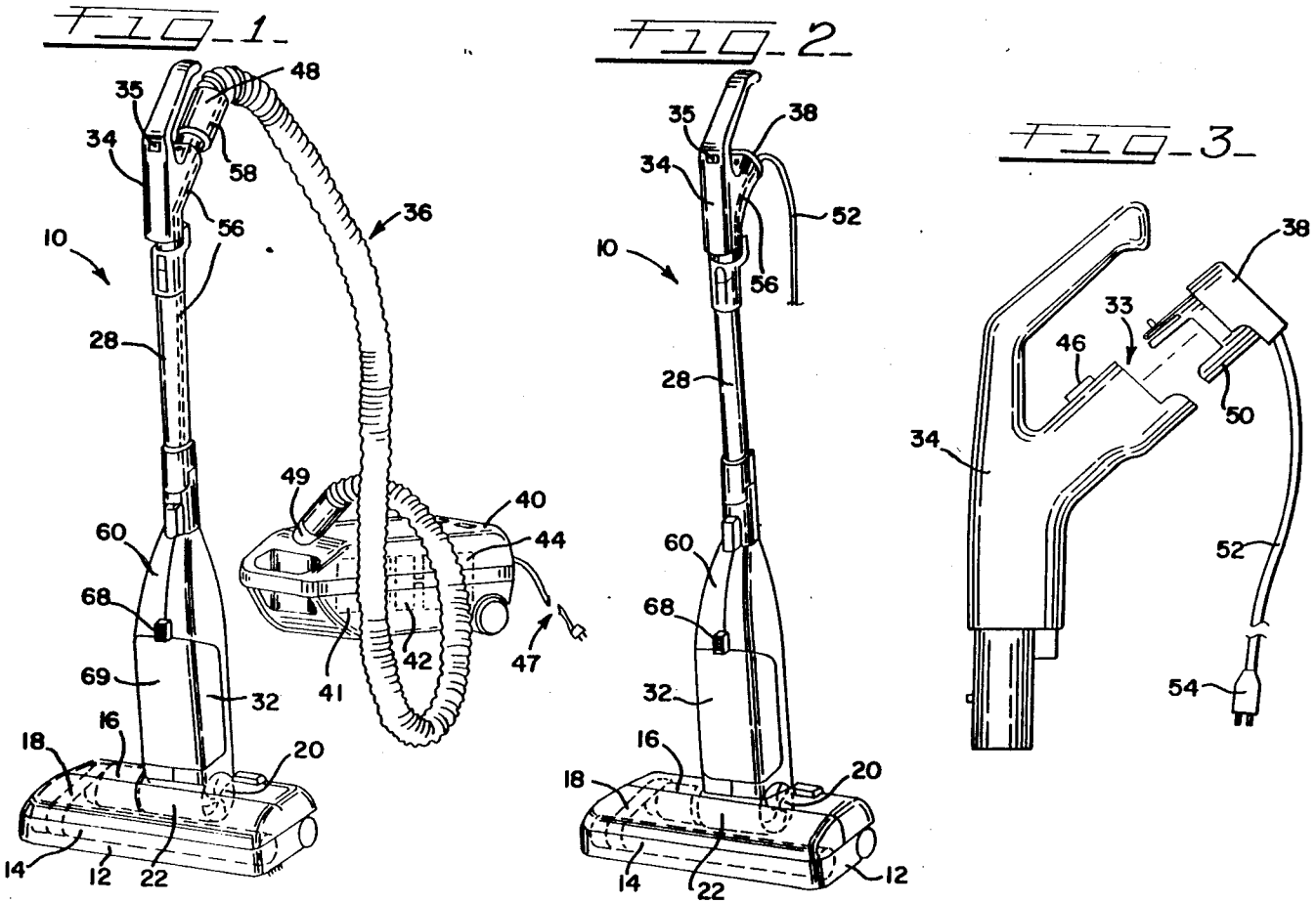
FIG. 1 is a perspective view of a vacuum cleaner constructed in accordance with the principles of the present invention and operated as a canister vacuum cleaner.
FIG. 2 is a perspective view of the vacuum cleaner shown in FIG. 1 operated as a stand alone vacuum cleaner.
FIG. 3 is an enlarged side view of the vacuum cleaner handle shown in FIG. 2.
Figures 5, 6, 7:
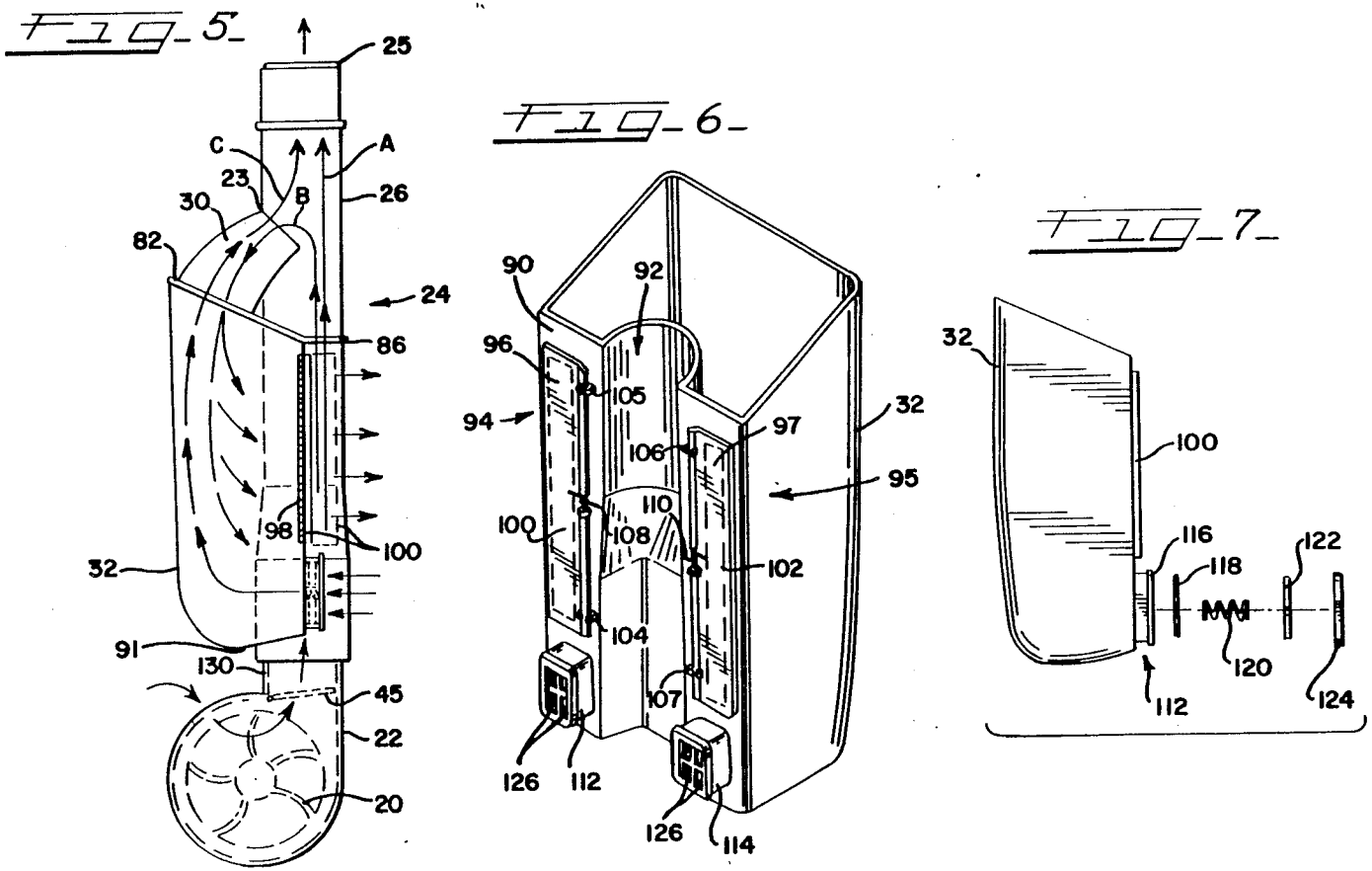
FIG. 5 is a side view of the dirt tube, dirt box and swivel of the vacuum cleaner shown in FIGS. 1 and 2, illustrating air flow paths in various modes of operation.
FIG. 6 is a perspective view of the dirt box shown in FIGS. 1 and 2 as seen from the rear.
FIG. 7 is a side view of the dirt box shown in FIG. 6 with an exploded view of an air inlet valve.

A vacuum cleaner 10 constructed in accordance with the present invention is operable as a canister vacuum cleaner as shown in FIG. 1 or as a stand alone, upright vacuum cleaner as shown in FIG. 2. The vacuum cleaner 10 includes a power nozzle assembly 12 having a beater brush 14 driven by a motor 16 that is coupled to the beater brush 14 by a belt 18. The motor 16 also drives a suction fan or impeller 20 disposed in a swivel 22 that is pivotable with respect to the power nozzle 12. The swivel 22, as shown in FIG. 5, has an air inlet 23 through which dirt picked up by the power nozzle enters. The swivel 22 is coupled to a rigid dirt tube assembly 24 having an air flow passageway 26 leading from the swivel 22 to a wand assembly 28. The dirt tube assembly 24 has another air flow passageway 30 coupled between the air flow passageway 26 and a dirt box 32 that forms a receptacle for collecting dirt when the vacuum cleaner 10 is operated as a stand alone vacuum cleaner. The wand assembly 28 forms an air flow passageway coupled between the air flow passageway 26 of the dirt tube assembly 24 and an air flow passageway formed in a handle 34. The handle 34 is alternatively interconnectable with a hose assembly 36 to provide a canister vacuum cleaner as shown in FIG. 1 and with a cap 38 to provide a stand alone, upright vacuum cleaner as shown in FIG. 2.

When the vacuum cleaner 10 is operated as a canister vacuum cleaner, the hose assembly 36 is connected to the handle 34 by inserting a mating portion 48 into an outlet port 33 of the handle 34 so as to connect the air flow passageway of the handle 34 with an air flow passageway formed by the hose assembly 36. The hose assembly 36 is coupled to a dirt receptacle 41 in a canister unit 40 wherein the canister unit 40 includes a motor 44 for driving a suction fan 42 that draws dirt from the power nozzle 12 through the dirt tube assembly 24, wand 28, handle 34 and hose assembly 36 to collect dirt in the canister unit when the vacuum cleaner 10 is operated as a canister vacuum cleaner. The suction fan 42 may also be operated to clean out the dirt box 32 in a clean out mode of operation when the swivel 22 is placed in an upright position, moving a flapper valve 45 to its closed position as shown in FIG. 5. When the hose assembly 36 is coupled to the handle 34, power lines 56(a portion of which are shown in phantom in the wand 28 and handle 34) extending from the nozzle motor 16 through the handle 34 are electrically connected to power lines 58 (a portion of which is shown in phantom in the mating portion 48) extending from the mating portion 48 through the hose assembly 36 and inlet port 49 to a conventional power cord 47 that extends from the canister unit 40 for electrical connection with an external power source to provide power to the nozzle motor 16 and canister motor 44.

To change the vacuum cleaner 10 from a canister vacuum cleaner as shown in FIG. 1 to a stand alone vacuum cleaner as shown in FIG. 2, a quick release button 46 is actuated to disengage the mating portion 48 of the hose assembly 36 from the handle 34. Thereafter, the cap 38 is connected to the handle 34 by inserting a connecting portion 50 of the cap 38 into the outlet port 33 of the handle 34 to seal the handle air flow passageway. Because the cap seals the handle air flow passageway, dirt picked up by the power nozzle is directed to the air flow passageway 30 of the dirt tube assembly 24 and into the dirt box 32, enabling the vacuum cleaner to operate as a stand alone vacuum cleaner. The cap 38 includes a power cord 52 having a plug 54 for connection with a standard external power source to provide power to the motor 16 through the power cord 52 and the power lines 56 which are electrically connected when the connecting portion 50 of the cap is inserted into the handle aperture 33.

Figure 4:
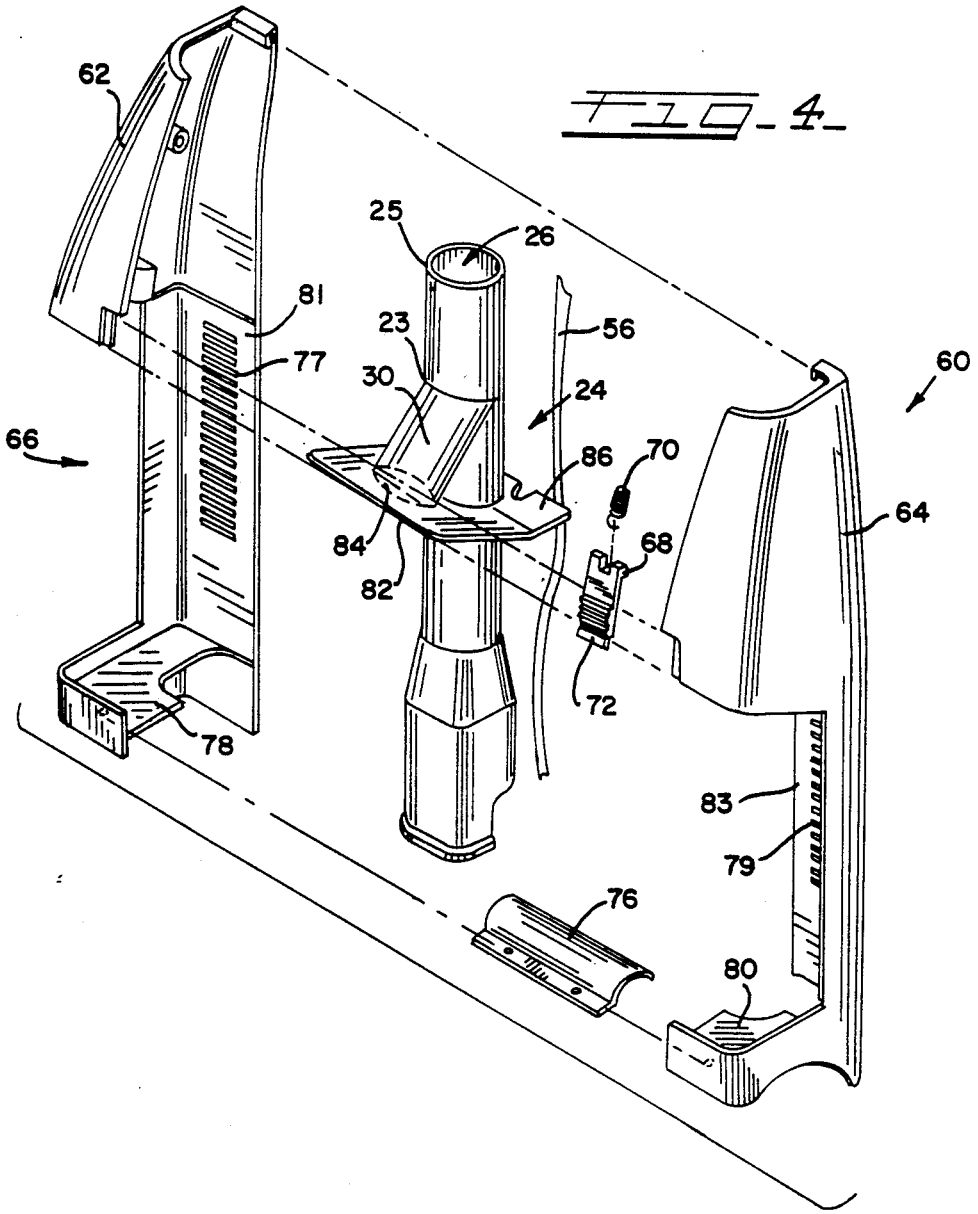
FIG. 4 is an exploded view of the dirt box/dirt tube housing assembly for the vacuum cleaner shown in FIGS. 1 and 2.

As shown in FIG. 4, the dirt tube assembly 24 is contained in a housing 60 formed of housing members 62 and 64 that cooperate together to support the dirt box 32. More particularly, when the housing members 62 and 64 are secured together, an aperture 66 is formed in the housing for receiving the dirt box 32. The dirt box 32 is removably retained in the housing 60 by a sliding latch 68 coupled to the housing 60 by a latch spring 70 that biases the latch 68 downward so that a flange 72 on the latch 68 engages the front 69 of the dirt box 32. The dirt box 32 is easily removed from the vacuum cleaner 10 by sliding the latch 68 upward so that the flange 72 no longer engages the dirt box 32. When inserted into the housing aperture 66, the bottom of the dirt box 32 rests on a seat spring 76 secured to base plate members 78 and 80 of respective housing members 62 and 64. The seat spring 76 acts in conjunction with the latch 68 and spring 70 to retain the dirt box 32 firmly seated in the housing aperture 66. The housing members 62 and 64 further include vents 77 and 79 formed in respective back walls 81 and 83 thereof so as to allow air exhausted from the dirt box 32 to pass through the housing 60 for stand alone vacuum cleaner operation and to allow air from outside of the housing 60 to enter the dirt box as required for the dirt box clean out operation as described in detail below.

Dirt-laden air is directed through an inlet port 23 into an air passageway 30 which communicates between the air passageway 26 and the dirt box 32. The dirt box 32 has a rigid body with a sidewall 90 and bottom 91, the top of the dirt box 32 being open to form an aperture through which dirt may flow. To seal the top of the dirt box 32, the dirt tube assembly 24 includes a cover member 82 having an aperture 84 therein for cooperating with the air passageway 30 wherein the cover 82 engages the top of the dirt box 32. The cover member 82 is angled slightly with respect to the air passageway 26 so as to accommodate the angled top periphery of the dirt box 32. A flange 86, extending from the cover 82 rearwardly and generally perpendicular to the air passageway 26, is provided with an indentation therein to accommodate the power lines 56.

As shown in FIG. 6, the dirt box 32 includes a rigid body formed of injected molded plastic. The rear of the side wall 90 of the dirt box is formed with an indentation 92 therein shaped to accommodate the dirt tube assembly 24 about which portions 94 and 95 of the dirt box 32 extend. The sidewall 90 further includes a pair of elongated apertures 96 and 97, shown in phantom, formed on opposite sides of the indentation 92 in the portions 94 and 95 to provide an exhaust for air when the vacuum cleaner 10 is operated as a stand alone vacuum cleaner as described in detail below. Disposed within each of the apertures 96 and 97 is a screen 98 or the like for filtering air passing through the apertures 96, 97. Flapper doors 100 and 102 are secured to the dirt box 32 by respective members 104, 105 and 106, 107 which allow the flapper doors 100 and 102 to be pivoted about respective axes extending through the members 104, 105 and 106, 107 so that the flapper doors 100 and 102 may be moved between closed positions as shown in FIG. 6 and an open position shown in phantom for the flapper door 100 in FIG. 5. Respective torsion springs 108 and 110 are provided to apply a force to the flapper doors 100 and 102 to maintain the doors closed as discussed below.

The rear of the sidewall 90 of the dirt box is further provided with a pair of air inlet valves 112 and 114 respectively disposed in the dirt box portions 94 and 95. Each of the air inlet valves 112 and 114 includes a valve body 116 having an aperture therein that cooperates with a respective aperture formed in the walls of the dirt box portions 94 and 95. A screen 118 is disposed within the aperture of the valve body 116 for filtering air. A compression spring 120 is positioned between the screen 118 and a plunger 122 having a diameter that is less than the diameter of the valve body aperture. A retaining cap 124 having apertures 126 therein is secured to the valve body 116 so as to retain the plunger 122 against the compression spring 120 in a normally closed position within the aperture formed in the valve body 116. A negative pressure within the dirt box 32 overcomes the force exerted by the compression spring 120 to pull the plunger 122 away from the retainer cap 124 to allow air to flow through apertures 126, around the plunger 122 and through the screen 118 to the interior of the dirt box 32 in order to clean out the dirt box 32 as described below.

To operate the vacuum cleaner 10 as a canister vacuum cleaner, the mating portion 48 of the hose assembly 36 is inserted into the handle outlet port 33 to connect the handle air flow passageway with the air flow passageway extending through the hose assembly 36 and to further electrically connect the power lines 56 for the nozzle motor 16 with the power lines 48 extending through the hose assembly 36. An ON/OFF switch 35 is then moved to the ON position to couple power from an external source through the canister power cord to the canister motor 44 and the nozzle motor 16. As shown in FIG. 1, the nozzle and canister suction fans 20 and 42 driven by respective motors 16 and 44 direct dirt from the beater brush 14, through the suction fan 20, and along a path A through the outlet port 25 of the dirt tube 24 and through the air flow passageways of the wand 28, handle 34 and hose assembly 36 to the receptacle in the canister unit 40 for collecting dirt. When the vacuum cleaner 10 is operated as a canister vacuum cleaner, the flapper doors 100 and 102 are maintained closed by the torsion springs 108 and 110. Because the nozzle suction fan 20 operates in conjunction with the canister suction fan 42 when the vacuum cleaner 10 is operated as a canister vacuum cleaner, improved dirt pick up is facilitated.

To operate the vacuum cleaner 10 as a stand alone, upright vacuum cleaner, the connecting portion 50 of the cap 38 is inserted into the handle aperture to seal off the handle air flow passageway and to connect the power lines 56 of the nozzle motor 16 with the power cord 52. When the power cord 52 is connected to an external power source through the plug 54 and the ON/OFF switch 35 is moved to the ON position, the nozzle motor 16 rotates the beater brush 14 and the suction fan 20 to direct dirt from the beater brush 14, through the suction fan 20, and along a path B through the air flow passageways 26 and 30 of the dirt tube assembly 24 to the dirt box 32 for collecting the dirt. When the vacuum cleaner 10 is operated as a stand alone vacuum cleaner, the positive pressure within the dirt box 32, created by the suction fan 20 and the sealed off handle air flow passageway, overcomes the force applied by the torsion springs 108 and 110 to open the flapper doors 100 and 102 so that air may be exhausted through the filter 98 disposed in the apertures 96 and 97 of the dirt box 32.

In order to clean out the dirt box 32, the hose assembly 36 is coupled to the handle 34 of the vacuum cleaner 10 and the swivel 22 is moved to an upright position. When the swivel 22 is placed in an upright position, a projection in the nozzle 12 engages a detent on the flapper valve 45 to cause the flapper valve 45 to rotate from a vertical position adjacent a portion 130 of a vertical front wall of the swivel 22. The flapper valve rotates in a clockwise manner to its closed position shown in FIG. 5 to block off air flow from the swivel 22 to the dirt tube assembly 24. When the canister suction fan 42 is operated with the flapper valve 45 blocking air flow from the swivel 22 to the dirt tube assembly 24, the negative pressure within the dirt box 32 created by the canister suction fan 42 pulls the plungers 122 away from the retainer caps 124 of the air inlet valves 112 and 114. Air is thus drawn along a path C through the apertures 126 of the retainer caps 124, around the plungers 122 and through the screens 118 into the dirt box 32 where the air and the dirt contained within the dirt box 32 are drawn up through the air passageway 26 of the dirt tube assembly 24 and through the air flow passageways of the wand 28, handle 34 and hose assembly 36 to the dirt receptacle in the canister unit 40. This feature allows the dirt box 32 to be automatically cleaned out so that the dirt need only be manually removed from the canister receptacle.

Because the vacuum cleaner of the present invention may be operated as a stand alone vacuum cleaner and as a canister vacuum cleaner, the advantages of both types of vacuum cleaners are realized with one unit. One advantage of such a combination is that the dirt box 32 used for stand alone vacuum cleaner operation may be automatically cleaned out using the canister suction fan. Further, the vacuum cleaner when operated as a canister vacuum cleaner provides increased cleaning action due to the combination of the nozzle suction fan and the canister suction fan which operate together.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A bag free dirt receptacle for a vacuum cleaner having at least one vacuum mode of operation and a clean-out mode of operation, said receptacle comprising:

a rigid body for collecting dirt having an aperture through which dirt laden air enters said rigid body during at least said vacuum mode of operation and is expelled from said rigid body during said clean-out mode of operation;

an exhaust means formed in said rigid body and having closure means for opening and closing said exhaust means, said closure means opening said exhaust means during said vacuum mode of operation and closing said exhaust means during said clean-out mode of operation; and air inlet means formed in said rigid body and having valve means for opening and closing said air inlet means, said valve means closing said air inlet means during said vacuum mode of operation and opening said air inlet means during said clean-out mode of operation.

2. A bag free dirt receptacle for a vacuum cleaner having at least and second vacuum modes of operation and a clean-out mode of operation, said receptacle comprising:

a rigid body for collecting dirt, said body having a plurality of walls with an aperture means formed in one of said plurality of walls through which dirt laden air enters said rigid body during at least said first vacuum mode of operation and is expelled from said rigid body during said clean-out mode of operation;

an exhaust means formed in one of said plurality of walls of said rigid body and having closure means for opening and closing said exhaust means, said closure means opening said exhaust means during said first vacuum mode of operation and closing said exhaust means during said second vacuum and clean-out modes of operation; and air inlet means formed in one of said plurality of walls of said rigid body and having valve means for opening and closing said air inlet means, said valve means closing said air inlet means during said first and second vacuum modes of operation and opening said air inlet means during said clean-out mode of operation.

3. A bag free dirt receptacle for a vacuum cleaner comprising:

a rigid body for collecting dirt, said body having a plurality of walls with an aperture means formed in one of said plurality of walls through which dirt laden air may flow into and out of said rigid body;

an exhaust means formed in one of said plurality of walls of said rigid body and having closure means for opening and closing said exhaust means, said closure means being responsive to the pressure within said rigid body; and air inlet means formed in one of said plurality of walls of said rigid body and having valve means for opening and closing said air inlet means, said valve means being responsive to the pressure within said rigid body.

4. A bag free dirt receptacle for a vacuum cleaner as recited in claim 3, wherein said exhaust means includes a filter.

5. A bag free dirt receptacle for a vacuum cleaner as recited in claim 3 including biasing means for biasing said closure means so as to close said exhaust means such that the force exerted by said biasing means is overcome by air pressure of a sufficient magnitude inside of said receptacle to open said closure means to allow air to exit said rigid body.

6. A bag free dirt receptacle for a vacuum cleaner as recited in claim 5 wherein said closure means includes a flapper door and said biasing means includes a spring.

7. A bag free dirt receptacle for a vacuum cleaner as recited in claim 3 wherein said body is formed of plastic.

8. A bag free dirt receptacle for a vacuum cleaner as recited in claim 2 wherein said valve means is responsive to a negative pressure within said dirt receptacle to open said air inlet means to allow air to enter said receptacle through said air inlet means, and including biasing means for biasing said closure means closed such that the force exerted by said biasing means to maintain said closure closed is overcome by a positive air pressure of a sufficient magnitude inside of said receptacle.

9. A bag free dirt receptacle for a vacuum cleaner as recited in claim 8 wherein said air inlet means includes an air inlet aperture formed in said rigid body, a screen disposed within said valve means; a plunger disposed within said valve means; a spring disposed between said plunger and said screen for resiliently retaining said plunger to close said air inlet aperture; wherein a negative pressure within said dirt receptacle overcomes the force exerted by said spring to pull said plunger away from said said air inlet aperture in order to open said air inlet means.

10. A bag free dirt receptacle for a vacuum cleaner as recited in claim 2 wherein said body is formed of plastic.

11. A bag free dirt receptacle for a vacuum cleaner as recited in claim 2 wherein said valve means is responsive to a negative pressure within said dirt receptacle to open said air inlet means in order to allow air to enter said dirt receptacle through said air inlet means.

12. A bag free dirt receptacle for a vacuum cleaner as recited in claim 11 wherein said valve means includes a valve body disposed about an air inlet aperture formed in said rigid body; means disposed in said air inlet aperture for filtering air; a plunger; a spring disposed between said plunger and filtering means and a cap secured to said valve body for retaining said plunger, said cap having an aperture formed therein and covered by said plunger when said valve means closes said air inlet means and is responsive to a negative pressure within said dirt receptacle such that the force exerted by said spring is overcome and said plunger is pulled away from said cap to allow air to flow through said cap aperture to said air inlet aperture.

13. A bag free dirt receptacle for a vacuum cleaner as recited in claim 2 wherein said closure means includes a flapper door secured to said rigid body and a spring for biasing said flapper door closed during said second vacuum and clean out modes of operation.

14. A bag free dirt receptacle for a vacuum cleaner as recited in claim 13 wherein said spring exerts a force to bias said flapper door closed, said force being overcome by air pressure inside of said receptacle of a sufficient magnitude to open said door.

15. A bag free dirt receptacle for a vacuum cleaner as recited in claim 2 wherein said body is formed of plastic.

16. A bag free dirt receptacle for a vacuum cleaner as recited in claim 1 wherein said valve means is responsive to a negative pressure within said dirt receptacle to change said air inlet means from being closed to being open to allow air to to flow into said dirt receptacle through said air inlet means and out through said aperture means during said clean-out mode of operation.

17. A bag free dirt receptacle for a vacuum cleaner as recited in claim 1 including a filtering means for said exhaust means wherein said closure means is responsive to a positive pressure within said dirt receptacle to change said exhaust means from being closed to being open to allow air from said dirt receptacle to flow out through said filtering means.

18. A bag free dirt receptacle for a vacuum cleaner as recited in claim 1 wherein said closure means includes a flapper door and means for exerting a force on said flapper door to bias said flapper door closed.

19. A bag free dirt receptacle as recited in claim 18 wherein said force exerting means includes a torsion spring.

20. A bag free dirt receptacle as recited in claim 18 wherein said flapper door is opened by air pressure within said dirt receptacle of a sufficient magnitude to overcome said force exerted by said force exerting means.

21. A bag free dirt receptacle for a vacuum cleaner as recited in claim 1 wherein said body is formed of plastic.

22. A bag free dirt receptacle for a vacuum cleaner as recited in claim 1 wherein said valve means includes a valve body disposed about an air inlet aperture formed in one wall of said rigid body; means disposed in said air inlet aperture for filtering air; a plunger; a spring disposed between said plunger and filtering means and a cap secured to said valve body for retaining said plunger, said cap having an aperture formed therein and covered by said plunger in the closed position wherein a negative pressure within said dirt receptacle overcomes the force exerted by said spring to pull said plunger away from said cap to allow air to flow through said cap aperture into said dirt receptacle.

* * * * *